US011358752B2

(12) United States Patent
Ferrando García et al.

(10) Patent No.: US 11,358,752 B2
(45) Date of Patent: Jun. 14, 2022

(54) SYSTEM FORMED BY A CONTAINER AND A COVER FOR TRANSPORTING AND CONSUMING LIQUIDS

(71) Applicant: Closca Design, S.L., Valencia (ES)

(72) Inventors: Carlos Nicolás Ferrando García, Valencia (ES); David Miguel Martín, Valencia (ES)

(73) Assignee: Closca Design, S.L., Valencia (ES)

( * ) Notice: Subject to any disclaimer, the term of this patent is extended or adjusted under 35 U.S.C. 154(b) by 79 days.

(21) Appl. No.: 16/626,810

(22) PCT Filed: Jun. 26, 2018

(86) PCT No.: PCT/ES2018/070454
§ 371 (c)(1),
(2) Date: Dec. 26, 2019

(87) PCT Pub. No.: WO2019/002650
PCT Pub. Date: Jan. 3, 2019

(65) Prior Publication Data

US 2020/0115108 A1 Apr. 16, 2020

(30) Foreign Application Priority Data

Jun. 27, 2017 (ES) ..... ES201730771U

(51) Int. Cl.

| | |
|---|---|
| ***B65D 25/36*** | (2006.01) |
| ***A45F 3/18*** | (2006.01) |
| ***B65D 1/06*** | (2006.01) |
| ***B65D 85/72*** | (2006.01) |

(52) U.S. Cl.
CPC ..... *B65D 25/36* (2013.01); *A45F 3/18* (2013.01); *B65D 1/06* (2013.01); *B65D 85/72* (2013.01); *A45F 2200/0583* (2013.01)

(58) Field of Classification Search
CPC .... B65D 25/36; B65D 25/34; B65D 81/3876; B65D 1/06; B65D 1/02; B65D 85/72; A61J 1/16; A45F 3/18; A45F 3/16
USPC ..... 220/739, 737, 592.17, 592.16, 504; 215/395; 206/547
See application file for complete search history.

(56) References Cited

U.S. PATENT DOCUMENTS

| | | | | |
|---|---|---|---|---|
| 3,071,281 A * | 1/1963 | Sawai | ..... | B65D 15/14 220/4.01 |
| 4,282,279 A | 8/1981 | Strickland | | |
| 5,318,821 A * | 6/1994 | Bradley, Jr. | ..... | B65D 25/34 150/154 |

(Continued)

FOREIGN PATENT DOCUMENTS

| | | |
|---|---|---|
| CN | 203186684 U | 9/2013 |
| FR | 2286765 A1 | 4/1976 |

(Continued)

*Primary Examiner* — Robert J Hicks
(74) *Attorney, Agent, or Firm* — The Webb Law Firm

(57) ABSTRACT

A system formed by a container and a cover for transporting and consuming liquids, including a container including: a main body; a first closure device at one end of the main body; a second closure device at an opposite end of the main body; and a cover that surrounds the main body of the container, the cover including a continuous band of elastic material forming a tubular body around the main body and an extension.

4 Claims, 2 Drawing Sheets

(56) References Cited

U.S. PATENT DOCUMENTS

| | | | | |
|---|---|---|---|---|
| 5,320,249 | A * | 6/1994 | Strech | B65D 81/3876 220/739 |
| 5,911,709 | A * | 6/1999 | Hogan | A61D 1/025 604/232 |
| 6,073,796 | A * | 6/2000 | Mogil | A45F 3/16 215/12.1 |
| 2003/0083601 | A1* | 5/2003 | Ballard | A61J 1/16 602/1 |
| 2004/0245207 | A1 | 12/2004 | Chomik | |
| 2007/0170189 | A1 | 7/2007 | Carlile | |
| 2009/0039045 | A1 | 2/2009 | Chen | |
| 2009/0266737 | A1 | 10/2009 | Cole | |
| 2010/0072234 | A1* | 3/2010 | Tymczyna | A45C 3/001 224/148.6 |
| 2010/0084362 | A1 | 4/2010 | Letchinger et al. | |
| 2010/0219150 | A1* | 9/2010 | Vinseiro | B65D 55/0854 215/40 |
| 2010/0288723 | A1* | 11/2010 | Mayer | B65D 1/06 215/316 |
| 2013/0213986 | A1 | 8/2013 | Couvelier | |
| 2014/0076940 | A1* | 3/2014 | Sprague | A45F 3/00 224/148.5 |
| 2016/0249758 | A1 | 9/2016 | Neiley et al. | |
| 2017/0369227 | A1* | 12/2017 | Metzger | B65D 81/3886 |

FOREIGN PATENT DOCUMENTS

| | | | |
|---|---|---|---|
| TW | M508262 | U | 9/2015 |
| WO | 2010132152 | A1 | 11/2010 |

* cited by examiner

SYSTEM FORMED BY A CONTAINER AND A COVER FOR TRANSPORTING AND CONSUMING LIQUIDS

CROSS-REFERENCE TO RELATED APPLICATIONS

This application is the United States national phase of International Application No. PCT/ES2018/070454 filed Jun. 26, 2018, and claims priority to Spanish Utility Model Application No. U201730771 filed Jun. 27, 2017, the disclosures of which are hereby incorporated by reference in their entirety.

BACKGROUND

Field of the Invention

The present invention relates to a container for transporting and consuming liquids, designed to be reusable and easily refillable, in addition, the transport and handling thereof is simple such that it can be used on a daily basis. The container object of the invention is applicable to the industry for manufacturing containers for foodstuffs, specifically the industry dedicated to the manufacture of containers for liquids.

Description of Related Art

Known bottles do not have an included securing system which allows the fastening thereof to different elements, but rather, for the securing, external objects are required, the functionality of which is limited and which involves an extra cost that the user must assume For example, in the bicycle sector, in order to secure a water bottle, the bicycle is equipped with a device for securing a water bottle which is screwed to the bicycle itself and which is designed especially for it. In turn the bicycle must have two housings for screwing the securing device, with a distance between the standardised screws.

Similarly, the trend of using disposable containers is becoming increasingly reduced in order to reduce the environmental impact which said disposable containers have. the smaller the container, the greater the quantity of plastic used with respect to the quantity of water it contains. That is to say, proportionally it is more inefficient because it uses more grams of plastic per litre of water. So low volume containers are especially inadvisable such as bottles of less than half a litre being desirable to reduce the use thereof.

SUMMARY

The described invention discloses a container for transporting and consuming liquids which has an included securing system to be used on multiple occasions, for example carrying it secured to the structure of a baby stroller, securing it to a bicycle frame or fastening it to the rod of an umbrella.

The container for transporting and consuming liquids object of the invention includes a main body, a first closure device at one end of the main body, a second closure device at an opposite end of the main body, and a cover that surrounds the main body of the container such that the cover includes a continuous band of elastic material forming a tubular body around the main body and an extension, such that in the extension the continuous band of elastic material has a variable thickness.

The first closure device of the container for transporting and consuming liquids object of the invention may include a first closure body having a base and a perimeter wall, and a sealing ring, wherein the first closure body is fastened to one end of the main body of the container, with the sealing ring placed between the first closure body and the main body.

In the container for transporting and consuming liquids, the second closure device may include a second closure body having a base and a perimeter wall and a sealing ring such that the second closure body is fastened to one end of the main body of the container, with the sealing ring placed between the second closure body and the main body such that the joint of the second closure body with the main body of the container is hermetic, preventing liquid from leaking from the inside of the main body.

The second closure body of the second closure device of the container for transporting and consuming liquids object of the invention may include a perimeter annular body of plastic material which prevents the container object of the invention from being displaced over a surface whereon the container is situated.

In the container for transporting and consuming liquids object of the invention the fastening between the first closure body and the main body and the one between the second closure body and the main body is by means of threading.

In the container for transporting and consuming liquids object of the invention, the continuous band of elastic material may include fastening means for fastening one end of the extension on the tubular body.

In the container for transporting and consuming liquids object of the invention, the main body may include a cylindrical segment and a narrowing at one end such that the first closure device is fastened in the narrowing and the second closure device at the opposite end.

In one embodiment of the container object of the invention, the first closure body may include a configuration in the shape of a truncated cone, having one end with dimensions similar to the cylindrical segment of the main body of the container and the other end with dimensions similar to the narrowing of the main body

BRIEF DESCRIPTION OF THE DRAWINGS

In order to complete the description and with the aim of aiding a better understanding of the features of the invention, as an integral part of the same, a number of drawings accompany said specification wherein the following has been represented in an illustrative and non-limiting manner.

Figure 1:
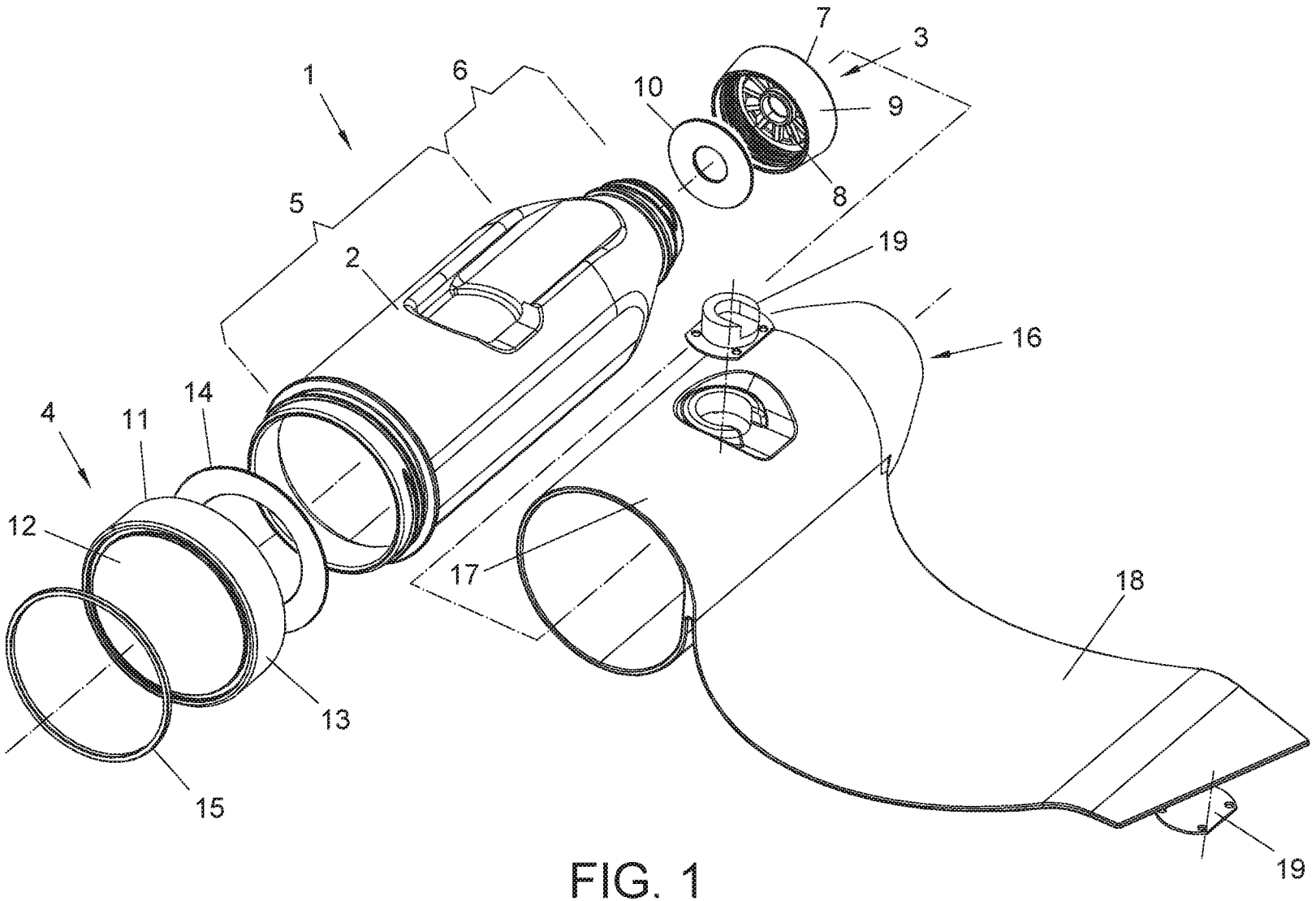
FIG. 1 shows an exploded view of the container for transporting and consuming liquids object of the invention.
Figure 2:
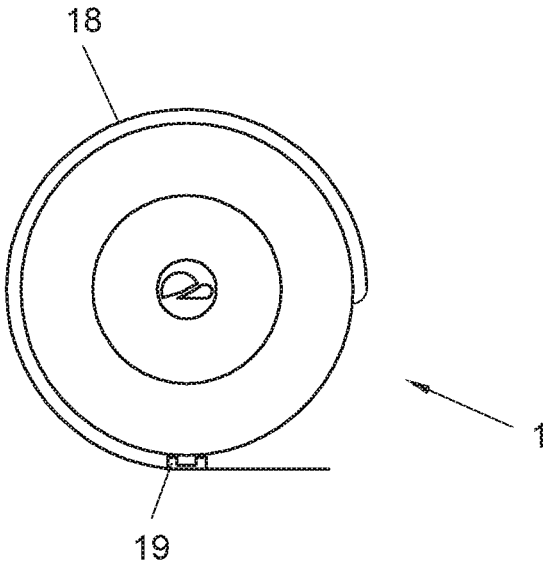
FIG. 2 shows a plan view of the container for transporting and consuming liquids object of the invention.
Figure 3:
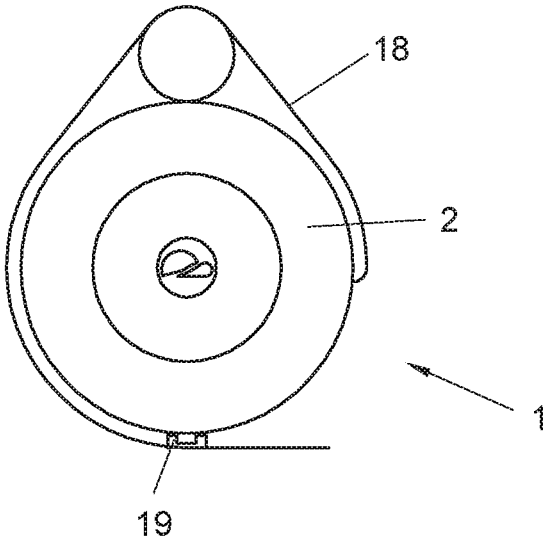
FIG. 3 shows a similar view to that of the figure with the container for transporting and consuming liquids object of the invention fastened to a tube.

The different reference numerals reflected in the figures correspond to the following elements:

1. container,
2. main body,
3. first closure device,
4. second closure device,
5. cylindrical segment,
6. narrowing,
7. first closure body,
8. base of the first closure body,
9. perimeter wall of the first closure body,

10. sealing ring of the first closure body,
11. second closure body,
12. base of the second closure body,
13. perimeter wall of the second closure body,
14. sealing ring of the second closure body,
15. perimeter annular wall,
16. continuous band,
17. tubular body,
18. extension, and
19. fastening means.

DESCRIPTION OF THE INVENTION

As indicated and as seen in the figures, the object of the invention is a container for liquids including a main body and a first closure device and a second closure device at opposite ends of the main body and which also includes a cover that surrounds at least the main body of the container and which is used to fasten the main body to an external element.

The main body may include a cylindrical segment and a narrowing at one end, forming a neck, such that in the narrowing the first closure device is fastened and, at the opposite end, is fastened the second closure device.

The first closure device may include a first closure body with a configuration in the form of a cup such that the first closure body includes a base and a perimeter wall such that in the non-limiting embodiment the base is circular. Furthermore, the first closure device includes a sealing ring to make the joint between the first closure body and the main body of the container hermetic. In the non-limiting embodiment of the invention, the first closure body is fastened to one end of the main body of the container by means of threading.

The first closure body (7) has the shape of a truncated cone, with one end with dimensions similar to the cylindrical segment (5) of the main body (2) of the container (1) and another end with dimensions similar to the narrowing (6) of the main body (2). The dimensions of the first closure body (7) similar to the cylindrical segment (5) of the main body (2) make said first closure body offer a stable support area in order to be able to situate the container (1) object of the invention on the first closure body (7) and use the container (1) like a glass for which the container (1) has to be opened by the second closure device (4).

The second closure device may include a second closure body with a configuration in the form of a cup, wherein the second closure body may include a base and a perimeter wall such that in the non-limiting embodiment the base is circular. Furthermore, the second closure device includes a sealing ring to make the joint between the second closure body and the main body of the container hermetic. In the non-limiting embodiment of the invention, the second closure device is fastened to one end of the main body of the container by means of threading. Lastly, the second closure body houses a perimeter annular body of plastic material.

The perimeter annular body (15) is designed to prevent the container (1), when resting on a surface through the second closure body (4), from slipping on the cited surface.

The cover includes comprises a continuous band of elastic material which is closed at one end forming a tubular body which is placed around the main body of the container object of the invention and the portion of the continuous band which does not form the tubular body forms an extension. The continuous band of elastic material may include fastening means to fasten one end of the extension on the tubular body, such that when the cover is not used to secure the main body of the container to the external element, the extension is situated surrounding the tubular body.

The extension (18) of the continuous band can be provided with a certain curvature with the aim of better adapting both to the manufacturing process and to the final shape folded over the main body (2). Likewise, the thickness of the continuous band (16) of elastic material in the extension (18) is smaller than the thickness of the continuous band (16) in the area forming the tubular body (17) with the aim of increasing the stretching capacity thereof. This thickness can have slight variations with the aim of compensating for or adjusting the deformation required over the entire length of the extension (18).

The fastening means (19) located on the continuous band can be implemented in multiple manners, namely: a magnetic anchor, a self-adhering surface (such as Velcro®), snap buttons . . . .

The invention should not be considered limited to the embodiments described in this document. Skilled persons in the art can develop other embodiments in view of the description given here. Therefore, the scope of the invention is defined by the following claims.

The invention claimed is:

1. A container for transporting and consuming liquids comprising:
- a main body,
- a first closure device at one end of the main body,
- a second closure device at an opposite end of the main body, and
- a cover that surrounds the main body of the container,
- wherein the cover comprises a continuous band of elastic material forming a tubular body and an extension, with the tubular body receiving the main body, and with the extension extending from the tubular body and configured for fastening the main body to an external element due to a stretching capacity of the elastic material.

2. The container of claim 1, wherein the continuous band of elastic material comprises fastening means for fastening one end of the extension on the tubular body.

3. The container of claim 2, wherein the continuous band of elastic material has a variable thickness in the extension.

4. The container of claim 2, wherein the fastening means comprises at least one of a magnetic anchor, a self-adhering surface, or snap buttons.

* * * * *